US008377261B2

(12) United States Patent
Bengtsson et al.

(10) Patent No.: US 8,377,261 B2
(45) Date of Patent: Feb. 19, 2013

(54) HIGH PRESSURE SLUICE FEEDER

(75) Inventors: Roland Bengtsson, Karlstad (SE); Per Toreld, Karlstad (SE); Lennart Gustavsson, Karlstad (SE)

(73) Assignee: Metso Paper Sweden AB, Sundsvall (SE)

( * ) Notice: Subject to any disclaimer, the term of this patent is extended or adjusted under 35 U.S.C. 154(b) by 0 days.

(21) Appl. No.: 13/264,477

(22) PCT Filed: May 4, 2009

(86) PCT No.: PCT/SE2009/050482

§ 371 (c)(1), (2), (4) Date: Nov. 3, 2011

(87) PCT Pub. No.: WO2010/128904

PCT Pub. Date: Nov. 11, 2010

(65) Prior Publication Data

US 2012/0037328 A1 Feb. 16, 2012

(51) Int. Cl.
*D21C 7/00* (2006.01)

(52) U.S. Cl. ..... 162/237

(58) Field of Classification Search ..... 162/232, 162/237, 239, 259, 264, 380; 406/63, 52; 209/274; 222/368
See application file for complete search history.

(56) References Cited

U.S. PATENT DOCUMENTS 5,236,285 A * 8/1993 Prough ..... 406/52
5,236,286 A * 8/1993 Prough ..... 406/52
5,443,162 A * 8/1995 Sherman ..... 209/274
7,350,674 B2 * 4/2008 Hoglund ..... 222/368

* cited by examiner

*Primary Examiner* — Mark Halpern
(74) *Attorney, Agent, or Firm* — Rolf Fasth; Fasth Law Offices

(57) ABSTRACT

The high pressure sluice feeder has a conical rotor mounted in a housing having a complementary conical interior. The rotor has a plurality of trough-going pockets arranged offset to each other in the rotor. The housing has ports distributed evenly around a circumference of the housing and exposed to the pockets during rotation of the rotor. A conical exterior surface of the rotor or the conical interior surface of the housing is equipped with a flush-out groove. The groove catches any abrasive particles caught between the complementary conical surfaces of the rotor and housing. The abrasive particles are flushed out towards the trough-going pockets of the rotor when one end of the groove is pressurized by either one neighboring trough-going pocket or a sealing liquid supply to a gable end of the rotor/housing.

6 Claims, 4 Drawing Sheets

HIGH PRESSURE SLUICE FEEDER

PRIOR APPLICATION

This application is a U.S. national phase application that is based on and claims priority from International Application No. PCT/SE2009/050482, filed 4 May 2009.

BACKGROUND AND SUMMARY OF THE INVENTION

Field of Invention

This application relates to a high pressure sluice.

The high pressure sluice feeder is an important component of the conventional Kamyr continuous pulping system. The high pressure sluice feeder is used to transfer steamed wood chips from a chute in a liquid from low pressure to high pressure and towards the top of the continuous digester. A typical high pressure sluice feeder comprises a rotor having through extending pockets disposed in first and second sets spaced along the axis of rotation of the rotor housing. The rotor pockets each have opposite end openings which function as both inlets and outlets depending upon the rotational position of the rotor, and the trough pockets in the rotor are offset from those of the other, typically orthogonally offset in the rotor in each set and 45 degrees offset between sets of trough pockets. The housing encloses the rotor and has an exterior periphery with first, second, third to fourth ports for each set disposed around the exterior periphery for registry with the inlets to and outlets from the pockets of the rotor. The first and third ports are opposite, typically arranged vertically, and the second and fourth ports are opposite, typically arranged horizontally, and the first and second ports may be adjacent in succession in the direction of rotation of the rotor.

In a conventional high pressure feeder are screen means disposed in the third port of each set for screening chips out of the liquid passing through the third port, and a low pressure pump is connected to the third port to provide the suction for sucking liquid through the third port while filling the rotor pocket with a chip slurry. However, in later conventional system with high pressure feeders have this screen means been removed, as is standard in Metso Papers Compact Feed™ systems. A high pressure pump or source of high pressure liquid is operatively connected to the fourth port to provide the flow of liquid under high pressure through the fourth port for emptying of the rotor pocket filed with chip slurry towards the digester via the second port. Normally the first port is on the top, and the third port on the bottom, the first port connected to the chip chute, and the second port connected to the top of the digester.

The rotor is slightly conical and have a form of a truncated cone and rests in a corresponding conical interior of the housing, and in order to minimize leakage of flow from the high pressure side to the low pressure side, i.e. from one rotor pocket to another, could the axial position of the rotor be adjusted in order to minimize the play between the conical circumference of the rotor and the conical interior surface of the housing. An automated system for pushing the rotor in the axial direction in order to maintain a predefined play, as these surfaces tends to wear, is shown in U.S. Pat. No. 7,350,674, and sold by Metso Paper.

However, it has been found that some high pressure feeders are worn down rather fast, and it has been identified that this accelerated process of wear is due to high content of abrasive particles in the chip slurry handled by the high pressure feeder. In some pulp mills is the chips stored in piles in outdoor wood yards, and even stored on gravel surface, and when chips are brought to feed systems is also some amount of grit and gravel brought together with the chips. This is often the main reason for excessive wear in subsequent equipment.

According to the present invention, the root cause of this excessive wear and an effective cure for reducing this wear has been found. After testing it has surprisingly been found that the wear rate in high pressure sluice feeders could be reduced by more than half, thus extending the operational time for a high pressure feeder between overhauls by over 100%.

According to the present invention the problem has been solved by providing flush out grooves in the complementary conical surface of the high pressure sluice feeder that are not swept by the trough going pockets of the rotor. Even though the play between the outer conical surface of the rotor and the conical interior surface of the housing should be kept at a minimum, could a better function be obtained by arranging grooves in these surfaces that are not swept by the trough going pockets of the rotor. Said grooves directing a flush out flow of liquid trough the grooves, thus emptying all abrasive particles caught in the grooves into the trough pockets of the rotor and into the passing chip slurry flow.

According to one embodiment of the invention are the grooves located in the rotor, and in another embodiment are the grooves located in the housing. These two alternatives could be combined such that grooves are located in the rotor as well as the housing.

It is the primary object of the present invention to provide for extended available operational life time between necessary overhauls of the high pressure sluice feeder. This and other objectives of the invention will become apparent from following description of the invention, and from the enclosed claims.

BRIEF DESCRIPTION OF THE DRAWINGS

FIG. 3*b* is a tilted view as seen from below in FIG. 1, while

DETAILED DESCRIPTION

Figure 1:
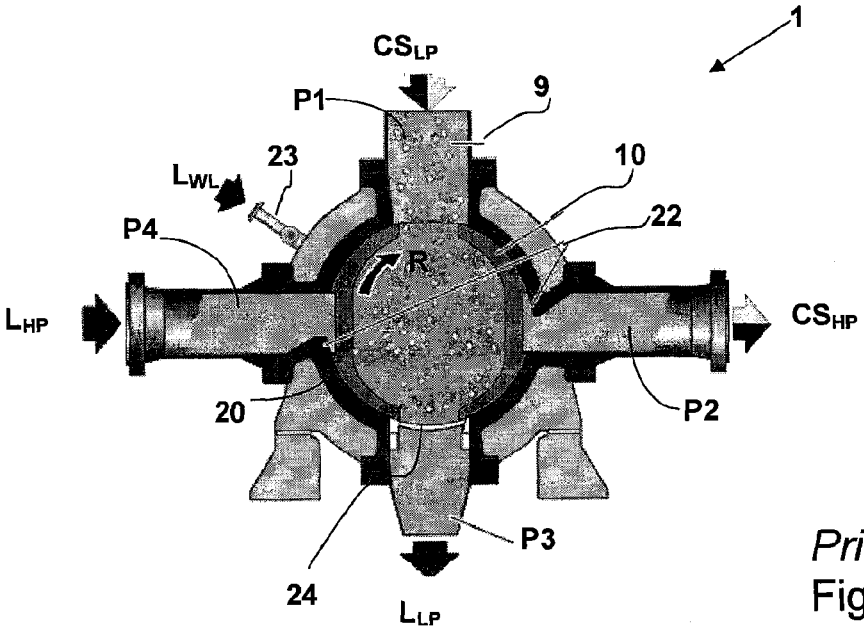
Prior Art Fig. 1
FIG. 1 is a schematic cross sectional side view of a high pressure feeder.

FIG. 1 shows the general design of a conventional high pressure sluice feeder 1 according state of the art. The high pressure sluice feeder 1 is connected to a chip chute 9, which is supplied with steamed chips from a conventional steaming vessel or bin, the chips being slurried with liquid. The chute 9 is connected to a first port P1 of a housing 20. The housing 20 also has a second port P2, a third port P3, and a fourth port P4, disposed at 90 degrees interval in the direction of rotation R of the rotor 10 within the housing 20. The rotor 10 has at least first and second through going pockets in one set (only one pocket shown in FIG. 1), wherein each individual pocket could be rotated into position of liquid communication with first and third ports, P1 and P3 respectively, of the housing, as shown in FIG. 1, or into position of liquid communication with second and fourth ports P2 and P4 of the housing.

Connected to the fourth port P4 is any suitable means for supplying high pressure liquid $L_{HP}$. Said high pressure liquid $L_{HP}$ could be obtained from a high pressure pump or a pressurized liquid from the digester, depending upon how the high pressure sluice feeder is installed in the feeding system.

A sealing liquid $L_{WL}$ is conventionally added to the housing via supply pipe 23. The sealing liquid is most often white liquor, or the cooking chemicals used, as most cooking systems need addition of cooking liquor early on, and thus could be added in this way and in this position. The sealing liquid is added to the end gable of the housing and lubricates the conical surfaces of the rotor and housing that are held in a predetermined minimal play against each other in order to minimize the leakage of high pressure liquid from one pocket to another, i.e. from the high pressure position to the low pressure position.

As shown in FIG. 1 is the individual pocket of the rotor 10 filled with chip slurry when the pocket is in register with ports P1 and P3, which is the low pressure position of the rotor. As shown in the figure could a screen member 24 be located in the port P3, such that the chips are prevented from escaping from the pocket, while liquid $L_{LP}$ being drained therefrom.

When the pocket is filled with chips in the position shown in FIG. 1, the rotor 10 continue the rotation in the direction R and expose the through going pocket for the second and fourth ports, P2 and P4 respectively. In this position the through going pocket is pressurized from the port P4 with a liquid $L_{HP}$ that expels the chips held in the pocket trough port P2 and further to the pressurized digester. Once the pocket is emptied, the rotor 10 continues to rotate in the direction R, and once again occupies the filling position as shown in FIG. 1, but at this time with inlets and outlets of the through going pocket being switched.

In a conventional manner is also the inside of the conical surface of the housing equipped with "pre-filling" grooves 22 running in the circumferential direction of the housing. The purpose of these "pre-filling" grooves 22 is to introduce a smooth pressurization of the through going pocket as it approaches the high pressure position. These grooves are running in the circumferential direction and should not be mixed up with the grooves of the invention, having an entirely different objective.

Figure 2A:
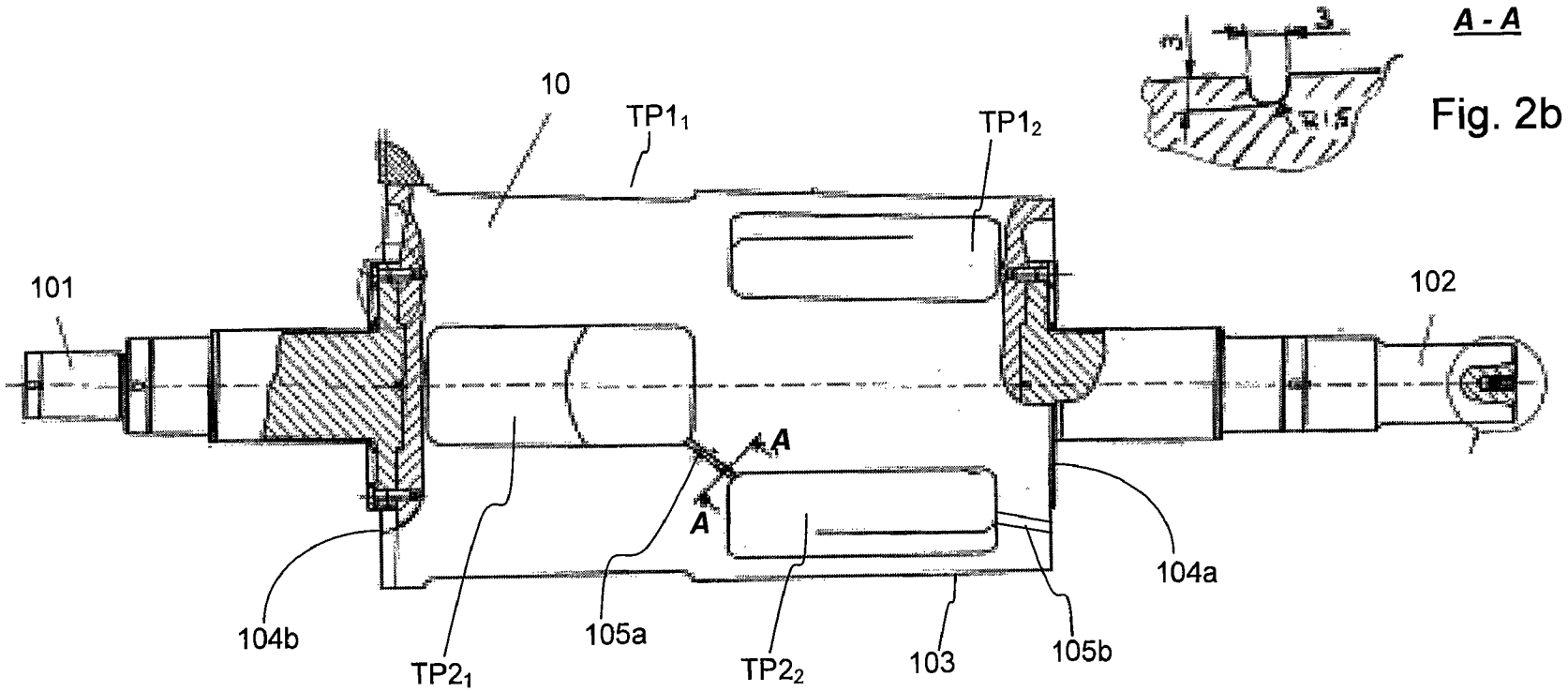
FIG. 2*a* is a side view of the rotor of the high pressure feeder with FIG. 2*b* showing a detail of the rotor in an enlarged view.

FIG. 2*a* illustrates the rotor 10 of the high pressure sluice feeder which is tapered from a first end thereof to the second gable end 104. As the wear increase the play between rotor and housing could the entire rotor be pushed towards the gable end, i.e. towards the right hand side in FIG. 2*a*. The rotor 10 includes a plurality of (e.g. four shown here) diametrically through-going pockets $TP1_1$, $TP2_1$, $TP1_2$, and $TP2_2$. Typically two pockets, $TP1_1$ (only inlet and outlet contours shown) and $TP2_1$ are disposed in a first set, and two pockets $TP1_2$ and $TP2_2$ in a second set, the sets spaced along the axial direction of the rotor, and the pockets of one set are orthogonally offset to each other in the circumferential direction, and sets being offset from each other at 45 degrees. The entire rotor 10 is journal led in bearings and connected to any appropriate drive unit via shaft ends 101 and 102.

According to the invention is the rotor equipped with a cleaning groove 105*a* as shown in FIG. 2*a*. This groove is arranged in the conical surfaces of the rotor, and said groove being oriented in a direction having at least one component running in parallel with the generatrix of the conical surface of the rotor, i.e. inclined as shown in FIG. 2*a*. Said groove 105*a* connecting one pocket $TP2_2$ with a fluid pressure source, said fluid pressure source establishing a flushing action trough said groove in a direction having one component in parallel with the generatrix of the conical surface of the rotor 2*a*. As shown in this embodiment is the groove 105*a* running between first and second through going pockets, here $TP2_2$ and $TP2_1$ in the outer peripheral surface of the conical rotor 10, and wherein the fluid pressure source is the pocket held at high pressure. The groove 105*a* is thus located in the outer peripheral surface of the conical rotor 10 that are not swept by the trough going pockets of the rotor during rotation thereof. If any grit or gravel is caught in this area it will not be emptied out into the trough going pockets when they are passing.

In FIG. 2*b* is shown a detail view of this groove 105*a*. In order to catch gravel and grit being caught between the conical surfaces of the rotor and the housing, in parts of the housing not being swept by the openings of the trough going pockets, it is sufficient if this groove has a width and depth laying in the range of 2-5 millimeter in the entire extension of the groove. In the embodiment shown in FIG. 2*b* is the width and depth 3 millimeters, and preferably with a radius of 1.5 millimeter in the bottom of the groove.

Figure 3B:
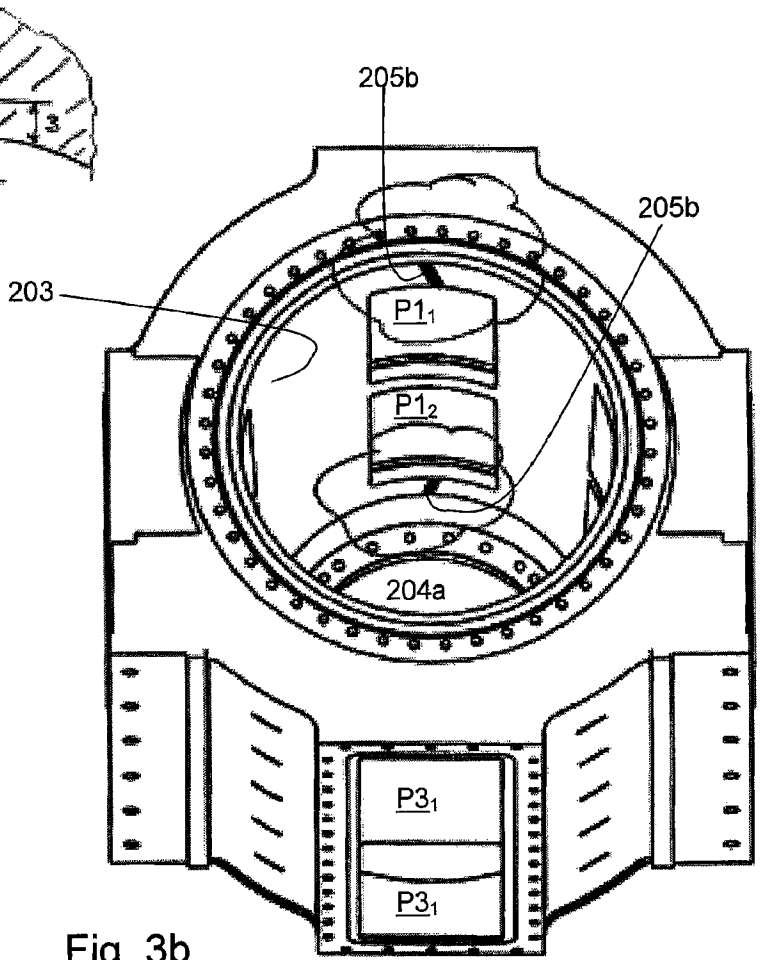
Figure 3C:
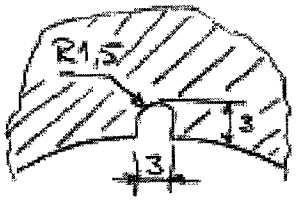
FIG. 3*c* is a detail of the housing in an enlarged view.
Figure 3A:
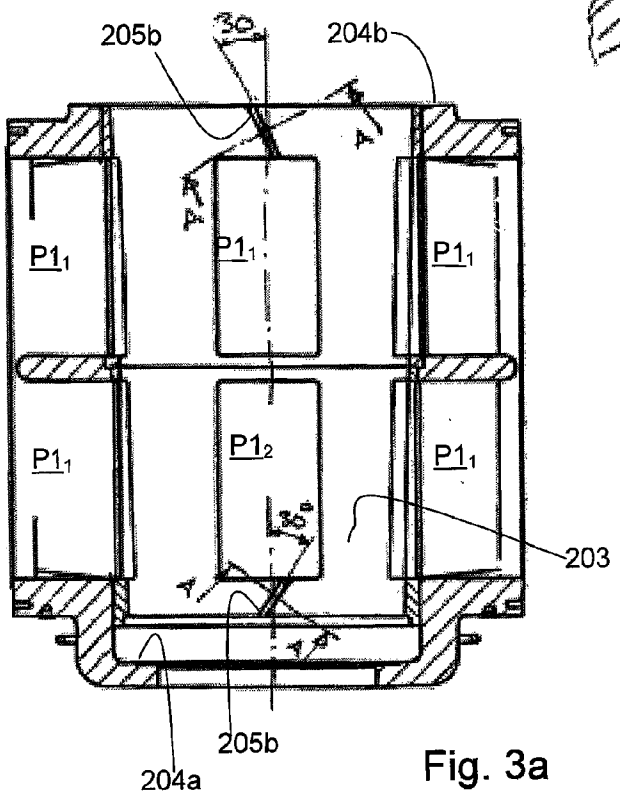
FIG. 3*a* is a cross sectional view of the housing in a high pressure feeder, as seen from below in FIG. 1.

According to the invention could also the housing 20 be equipped with cleaning grooves 205*b* as shown in FIGS. 3*a* and 3*b*. One groove 205*b* is running between a gable end 204*a* of the interior conical surface 203 of said housing to the neighboring port $P1_2$ closest to the gable end in said housing, and wherein the fluid pressure source is the supply of sealing liquid $L_{WL}$ added to the gable end of the rotor. As shown could a similar groove be applied, running between the opposite end 204*b* of the interior conical surface 203 of said housing to the neighboring port $P1_1$ closest to the gable end in said housing. In FIG. 3*c* is shown a detail view of this groove 205*b*, having similar preferred configuration as that of FIG. 2*b*. These ports $P1_1$ and $P1_2$ are both preferably located in the low pressure position of the high pressure sluice feeder, and preferably the inlet ports for the low pressure filling position.

Figure 4B:
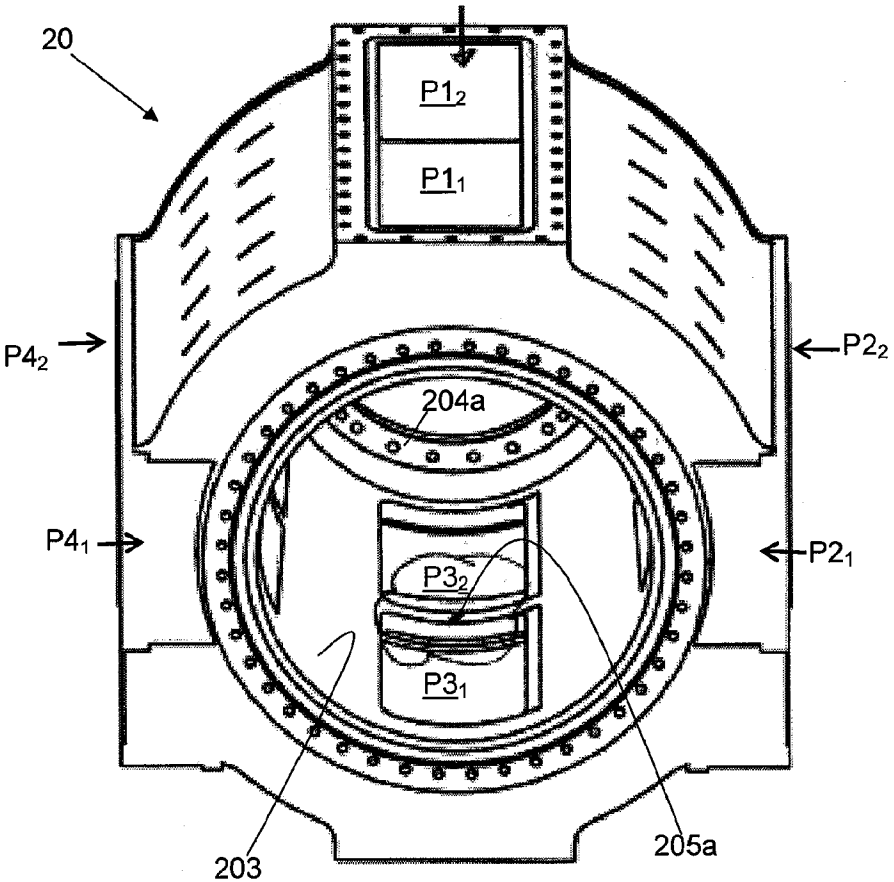
FIG. 4*b* is a tilted view as seen from above in FIG. 1.
Figure 4A:
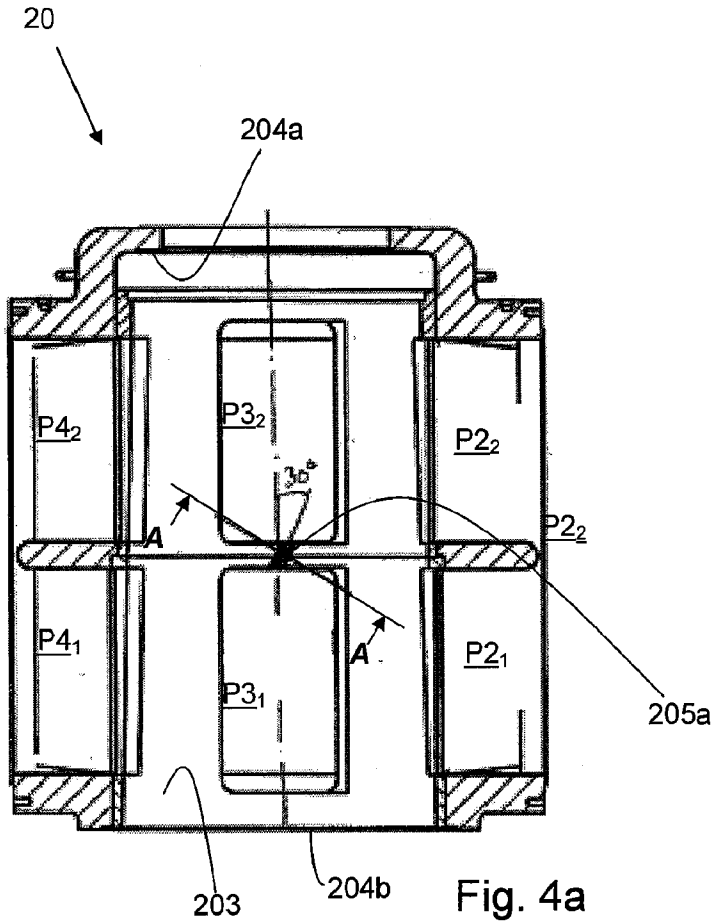
FIG. 4*a* is a cross sectional view of the housing in a high pressure feeder, as seen from above in FIG. 1.

In FIGS. 4*a* and 4*b* is shown that a cleaning grove 205*a* also could be located running between two neighboring ports $P3_1$ and $P3_2$ in the interior conical surface of the housing. These ports $P3_1$ and $P3_2$ are both preferably located in the low pressure position of the high pressure sluice feeder, and preferably the inlet ports for the low pressure filling position.

Figure 5:
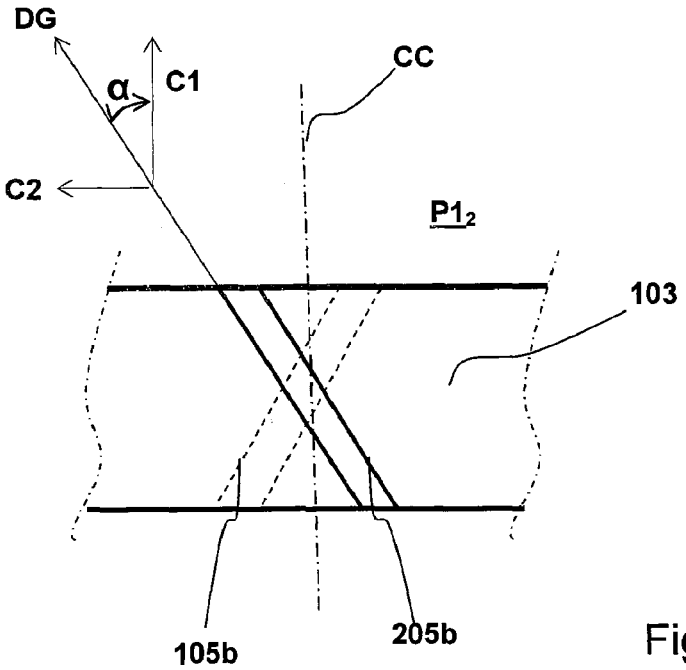
FIG. 5 is a detail view of the groove in the housing.

The groove 205*b*, as shown by the upper groove in FIG. 3*a*, and its general direction DG is shown in FIG. 5, stretching from a port $P1_1$ in the housing and towards the end opposite the gable end 204, and located in the interior conical surface of the housing that is not swept by the trough going channels of the rotor. The groove being oriented in a general direction DG having at least one component C1 running in parallel with the generatrix of the interior conical surface of the housing, i.e. with an inclination angle of $\alpha$, in relation to the generatrix of the interior conical surface of the housing as shown in FIG. 5. The inclination angle $\alpha$ is lying in the range 10-50 degrees, preferably 30 degrees, in relation to the generatrix of the interior conical surface of the housing or rotor. Said groove 205*b* establishing a flushing action trough said groove in a general direction DG having one component C1 in parallel with the generatrix of the interior conical surface of the housing. If the rotor is equipped with a similar groove for cleaning purposes, this groove in the rotor is preferably oriented such that it may cross the groove of the housing when passing, as indicated by dotted lines of a ghost groove 105*b* in the rotor.

While the invention has been herein shown and described in what is presently conceived to be the most preferred embodiment, it will be apparent to those skilled in the art that many modifications may be made thereof within the scope of the invention, which scope is to be accorded the broadest interpretation of the appended claims so as to encompass all equivalent structures and procedures.

While the present invention has been described in accordance with preferred compositions and embodiments, it is to be understood that certain substitutions and alterations may be made thereto without departing from the spirit and scope of the following claims.

The invention claimed is:

1. A high pressure sluice feeder for transferring a chip slurry from a low pressure level to a high pressure level, comprising:

a conical rotor having a first through-going pocket and a second through-going pocket defined therein, the conical rotor being rotatable about a given axis (CC) of rotation and the first and second through-going pockets having opposite end-openings functioning as both inlets and outlets depending upon a rotational position of the conical rotor, the first through-going pocket being offset from the second through-going pocket in the rotational position of the conical rotor;

a housing enclosing the conical rotor, the housing having an exterior periphery and at least a first set of first, second, third and fourth ports defined therein disposed around the exterior periphery thereof for registry with the inlets to and outlets from each first and second through-going pocket;

the first port being opposite the third port, the second port ($F\mathbf{2}_1$) being opposite the fourth port ($P\mathbf{4}_1$), the housing having an interior conical surface congruent with an outer conical surface of the conical rotor;

means for mounting the conical rotor in the housing, means for rotating the conical rotor with respect to the first, second, third and fourth ports about the given axis (CC) of rotation, and in a first direction, the outer conical surface being held at a predetermined play in relation to the interior conical surface of the housing in order to minimize leakage of pressure from pockets held at high pressure to pockets held at low pressure;

the outer conical surface or the housing having a groove defined therein, the groove being oriented in a general direction (DG) having at least one component (C1) running in parallel with a generatrix of the interior conical surface of the housing or the outer conical surface of the rotor, the groove connecting one of the first, second, third or fourth pocket with a fluid pressure source, and the fluid pressure source having means for establishing a flushing action trough the groove in a direction having one component in parallel with the generatrix of the interior conical surface.

2. A high pressure sluice feeder as recited in claim 1 wherein the groove extends between the first and second through-going pockets in the outer conical surface of the conical rotor, and wherein the fluid pressure source is a pocket held at high pressure.

3. A high pressure sluice feeder as recited in claim 2 wherein the groove extends between a gable end of the conical rotor and the first or second through-going pocket in the outer conical surface of the conical rotor, and wherein the fluid pressure source is a supply of sealing liquid added to the gable end of the conical rotor.

4. A high pressure sluice feeder as recited in claim 1 wherein the groove extends between two neighboring ports of a first and second sets of ports in the interior conical surface of the housing.

5. A high pressure sluice feeder as recited in claim 4 wherein the groove extends between a gable end of the interior conical surface of the housing and a first neighboring port closest to the gable end of the interior conical surface of the housing, and wherein the fluid pressure source is a supply of sealing liquid ($L_{WL}$) added to a gable end of the conical rotor.

6. A high pressure sluice feeder as recited in claim 1 wherein a width and depth of the groove is in a range of 2-5 millimeters.

* * * * *